US005997340A

United States Patent [19]

Ito et al.

[11] Patent Number: 5,997,340

[45] Date of Patent: Dec. 7, 1999

[54] WIRE CONNECTING STRUCTURE OF CONNECTOR AND PRODUCTION METHOD THEREOF

[75] Inventors: Naoki Ito; Akira Shinchi, both of Shizuoka-ken, Japan

[73] Assignee: Yazaki Corporation, Tokyo, Japan

[21] Appl. No.: 08/995,752

[22] Filed: Dec. 22, 1997

[30] Foreign Application Priority Data

Dec. 26, 1996 [JP] Japan ..... P8-348280

[51] Int. Cl.[6] ..... H01R 13/405

[52] U.S. Cl. ..... 439/460; 439/736

[58] Field of Search ..... 439/460, 604, 439/606, 736

[56] References Cited

U.S. PATENT DOCUMENTS

| | | | |
|---|---|---|---|
| 3,993,396 | 11/1976 | Eigenbrode | 439/736 |
| 4,092,058 | 5/1978 | Eignebrode | 439/736 |
| 5,584,122 | 12/1996 | Kato et al. | 29/872 |
| 5,857,259 | 1/1999 | Johnston | 439/736 |

FOREIGN PATENT DOCUMENTS 7-70345 7/1995 Japan .

*Primary Examiner*—Ren Yan

*Assistant Examiner*—Amanda B. Sandusky

*Attorney, Agent, or Firm*—Finnegan, Henderson, Farabow, Garrett & Dunner, L.L.P.

[57] ABSTRACT

A wire connecting structure of a connector comprises a connector housing, a terminal holding portion protruding from an end of the connector housing, terminal incorporating holes which are provided in the terminal holding portion and communicate with the connector housing, terminals disposed within the terminal incorporating holes, covered wires placed on the terminals, and upper hole wall portions which are provided in the terminal holding portion to define upper portions of the terminal incorporating holes and when pressed, subside into the terminal incorporating holes so as to contact the covered wires, core elements of the covered wire and the terminal being subjected to ultrasonic vibration through the upper hole wall portion which is pressed so as to contact the covered wire, so that the core elements and the terminal are conductively contacted with each other, the upper hole wall portion being settled by fusion in each of the terminal incorporating holes by the ultrasonic vibration.

6 Claims, 7 Drawing Sheets

WIRE CONNECTING STRUCTURE OF CONNECTOR AND PRODUCTION METHOD THEREOF

BACKGROUND OF THE INVENTION

1. Field of the Invention

This invention relates to a connector wire connecting structure in which a connector terminal is connected to wires by means of ultrasonic vibration and a production method thereof.

2. Description of Relevant Art

This kind of the wire connector structure and a production method thereof have been disclosed in Japanese Patent Publication No.7-70345.

This disclosed art, as shown in FIGS. 1A, 1B and 2, comprises a first member 100 in which small concave portions 100*b* are formed on a bottom of a groove portion 100*a* and a second member 200 in which small convex portions 200*b* are formed on a top face of the convex portion 200*a* which engages the groove portion 100*a*. In the groove portion 100*a*, a terminal 300 is placed and a covered wire 400 is stacked on this terminal 300. Then, the small concave portions 100*b* and small convex portions 200*b* are aligned with each other and then the second member 200 is fit to the first member 100. With this condition, with both the first member 100 and second member 200 pressed together, ultrasonic vibration is applied thereto. Consequently, the cover portion of the covered wire 400 placed between the small concave portions 100*b* and small convex portions 200*b* is fused so that the core and terminal 300 are conductively contacted with each other. At the same time, both the first member 100 and second member 200 are integrally fused so as to obtain a connector 500.

However, in this conventional wire connection structure, both the first member 100 and second member 200 are required, and therefore a number of components increases. Further, upon engagement between the first member 100 and second member 200, the small concave portions 100*b* and small convex portions 200*b* must be aligned with each other accurately, and therefore efficiency of the connecting operation drops, thereby finally resulting in drop of total production efficiency.

SUMMARY OF THE INVENTION

Accordingly, it is an object of the present invention to provide a connector wire connecting structure requiring only a small number of components and not necessitating engagement work between those components, thereby improving total production efficiency, and a production method thereof.

To achieve the object, a first aspect of the invention provides a wire connecting structure of a connector, comprising: a connector housing; a terminal holding portion protruding from an end of the connector housing; terminal incorporating holes which are provided in the terminal holding portion and communicate with the connector housing; terminals disposed within the terminal incorporating holes; covered wires placed on the terminals; and upper hole wall portions which are provided in the terminal holding portion to define upper portions of the terminal incorporating holes and when pressed, subside into the terminal incorporating holes so as to contact said covered wires, core elements of the covered wire and the terminal being subjected to ultrasonic vibration through the upper hole wall portion which is pressed so as to contact the covered wire, so that the core elements and said terminal are conductively contacted with each other, the upper hole wall portion being settled by fusion in each of the terminal incorporating holes by the ultrasonic vibration.

According to the first aspect, by inserting a covered wire into a terminal incorporating hole, positioning between the covered wire and a terminal is achieved. Further, because an interposition part upon ultrasonic vibration is a sunk upper hole wall portion in the terminal incorporating hole, positioning of the interposition part is not necessary. Further, such interposition parts as a cover or the like are not required, thereby achieving reduction of the number of components.

Accordingly, total production efficiency can be improved.

The cover portion of the covered wire is melted and removed by ultrasonic vibration so that core elements thereof are conductively contacted with the terminal. This conductive contacting state is secured by settling of the sunk upper hole wall portion in the terminal incorporating hole.

To achieve the object, a second aspect of the invention provides a wire connecting structure of a connector according to the first aspect wherein the upper hole wall portion has protrusions protruding above an external face of the terminal holding portion and each of the protrusions subsides into each of the terminal incorporating holes.

According to the second aspect, ultrasonic vibration is applied to the covered wire through the upper hole wall portion which subsides at each protrusion. Consequently, the cover portion thereof is melted and removed so that the core elements are conductively contacted with the terminal. The sunk upper hole wall portion is settled by fusion in each of the terminal incorporating holes while the protrusion clogs an opening of the sinking portion.

Accordingly, as described above, the sunk upper hole wall portion is used as an interposition part for ultrasonic vibration. Thus, reduction of the number of components can be achieved.

To achieve the object, a third aspect of the invention provides a wire connecting structure of a connector according to the first or second aspect, further comprising: cutting trigger means provided between the upper hole wall portion and the terminal holding portion, which triggers breakage, the upper hole wall portion being sunk when the cutting trigger means is broken, and settled by fusion in each of the terminal incorporating holes.

According to the third aspect, the upper hole wall portion is broken easily by the cutting trigger means so that it is sunk into each of the terminal incorporating holes. Because of provision of the cutting trigger means, only the upper hole wall portion can be sunk without damaging the other portion of the external surface of the terminal holding portion.

Accordingly, the upper hole wall portion is broken easily by the cutting trigger means so that it is sunk into each of the terminal incorporating holes, thereby improving the work efficiency.

To achieve the object, a fourth aspect of the invention provides a wire connecting structure of a connector according to the first aspect wherein the upper hole wall portion is a block body which is connected to the terminal holding portion through thin portions for clogging an upper opening of each of the terminal incorporating holes.

According to the fourth aspect, ultrasonic vibration is applied to the covered wire through the block body. Consequently, the cover portion thereof is melted and removed so that the core elements are conductively contacted with the terminal. The sunk block body substantially clogs the opening of that sunk portion and is settled by fusion in each of the terminal incorporating holes. Because the sinking of this block body is carried out by breaking of the thin portion, the other portion of the external face of terminal holding portion is not damaged.

Accordingly, the block body forming the external face of the terminal holding portion is utilized as an interposition part for ultrasonic vibration. Thus, reduction of the number of components can be achieved.

To achieve the object, a fifth aspect of the invention provides a wire connecting structure of a connector according to the fourth aspect, wherein the terminal holding portion has small protrusions protruding above the external face of the upper opening edge of each of the terminal incorporating holes, the small protrusion clogging a gap between the block body which is melted by the ultrasonic vibration and sunk, and the upper opening edge.

According to the fifth aspect, the small protrusions are melted at the same time when the block body is settled by fusion in each of the terminal incorporating holes, so that a gap between the block body and upper opening edge of the terminal incorporating hole is clogged.

Accordingly, slippage of the block body from the terminal incorporating hole is effectively prevented so that conductive contact between the core elements of the covered wire and terminal is maintained stably.

To achieve the object, a sixth aspect of the invention provides a production method of a wire connecting structure of a connector according to the first aspect, wherein after the covered wire is placed on a terminal in each of the terminal incorporating holes, the upper hole wall portion is sunk into each of the terminal incorporating holes by sinking means, and ultrasonic vibration is applied while pressing the covered wire through the sunk upper hole wall portion so as to melt and remove a cover portion of the covered wire and make core elements of the covered wire and the terminal into conductive contact with each other, and the sunk upper hole wall portion is settled by fusion.

According to the sixth aspect, a fitting work of an interposition part for ultrasonic vibration upon the covered wires is not necessary. Further, conductive contact between the core elements of covered wire and terminal, and settlement by fusion of the upper hole wall portion into each of the terminal incorporating holes can be achieved in a single step of the aforementioned ultrasonic vibration. Thus, work efficiency can be improved thereby raising total production efficiency.

To achieve the object, a seventh aspect of the invention provides a production method of a wire connecting structure of a connector according to the sixth aspect wherein, the sinking measure is ultrasonic vibration measure and after the upper hole wall portion is pressed by the ultrasonic vibration measure and sunk by ultrasonic vibration, the ultrasonic vibration is continued through the sunk upper hole wall portion so as to make core elements of the covered wire and the terminal into conductive contact with each other, so that the sunk upper hole wall portion is settled by fusion in each of the terminal incorporating holes.

According to the seventh aspect, by the ultrasonic vibration measure, sinking of the upper hole wall portion, conductive contact between the core elements of the covered wire and terminal, and settlement by fusion of the sunk upper hole wall portion in each of the terminal incorporating holes can be achieved in a single step, thereby further improving the work efficiency.

To achieve the object, an eighth aspect of the invention provides a production method of a wire connecting structure of a connector according to the sixth aspect wherein the sinking measure is cutter measure and after the upper hole wall portion is sunk by cutting with the cutter measure, the ultrasonic vibration measure is applied through the sunk upper hole wall portion so as to make core elements of the covered wire and the terminal into conductive contact with each other by ultrasonic vibration and so that the sunk upper hole wall portion is settled by fusion in each of the terminal incorporating holes.

According to the eight aspect, the upper hole wall portion is sunk by the cutter measure. Thus, only the upper hole wall portion can be sunk without damaging the other portion of the external face of the terminal holding portion.

Accordingly, a good-looking wire connecting structure of a connector can be obtained without damaging the other portion of the external face of the terminal holding portion.

BRIEF DESCRIPTION OF THE ACCOMPANYING DRAWING

The above and further objects and novel features of the present invention will more fully appear from the following detailed description when the same is read in conjunction with the accompanying drawings, in which:

FIGS. 1A, 1B show production steps of a conventional connector while FIG. 1A is a longitudinal sectional view thereof and FIG. 1B is a right side view thereof;

FIGS. 3A, 3B show a connector having a wire connecting structure according to a first embodiment of the present invention while FIG. 3A is a perspective view thereof and FIG. 3B is a sectional view taken along the lines Ib—Ib of FIG. 3A;

FIGS. 8A, 8B show a modification of the connector shown in FIG. 3A while FIG. 8A is a sectional view of major portion before sinking and FIG. 8B is a sectional view of major portion after formation is completed;

Figure 9A:
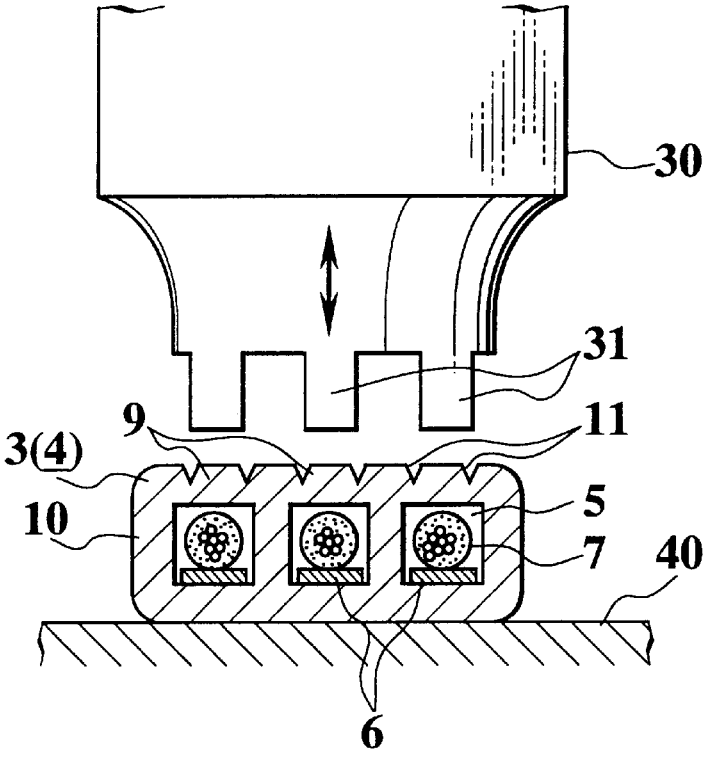
Figure 9B:
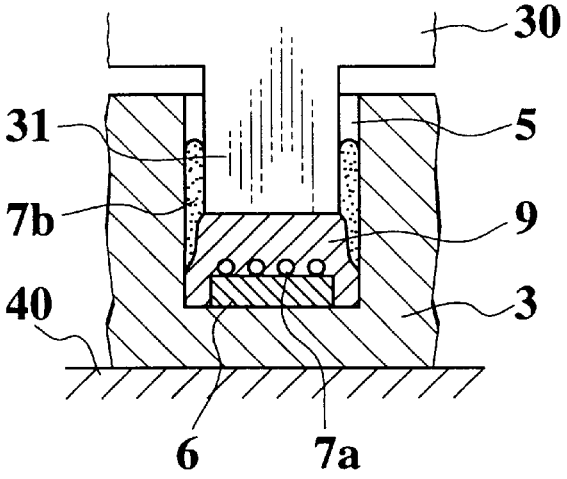
Figure 10A:
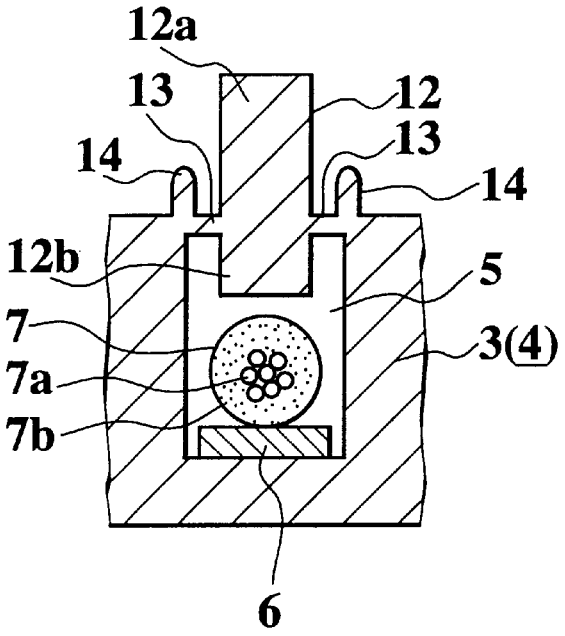
Figure 10B:
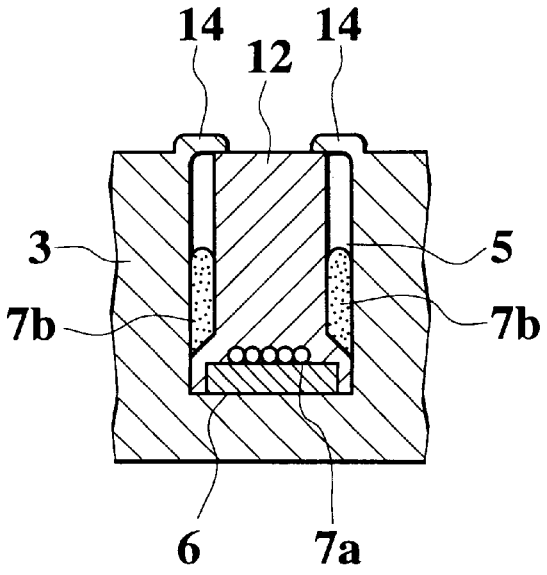

FIGS. 9A, 9B are sectional views showing production step of a wire connecting structure according to a third embodiment of the present invention, while FIG. 9A show a state before production and FIG. 9B shows a state of production final step; and FIGS. 10A, 10B are sectional views of major portion of a connector housing for use in a wire connecting structure according to a fourth embodiment of the present invention, while FIG. 10A shows a state before production and FIG. 10B shows a state after production.

DETAILED DESCRIPTION OF THE PREFERRED EMBODIMENTS

The contents of U.S. Pat. No. 5,584,122 are incorporated herein by reference.

Hereinafter, the preferred embodiments of the present invention will be described with reference to the accompanying drawings.

Figure 3A:
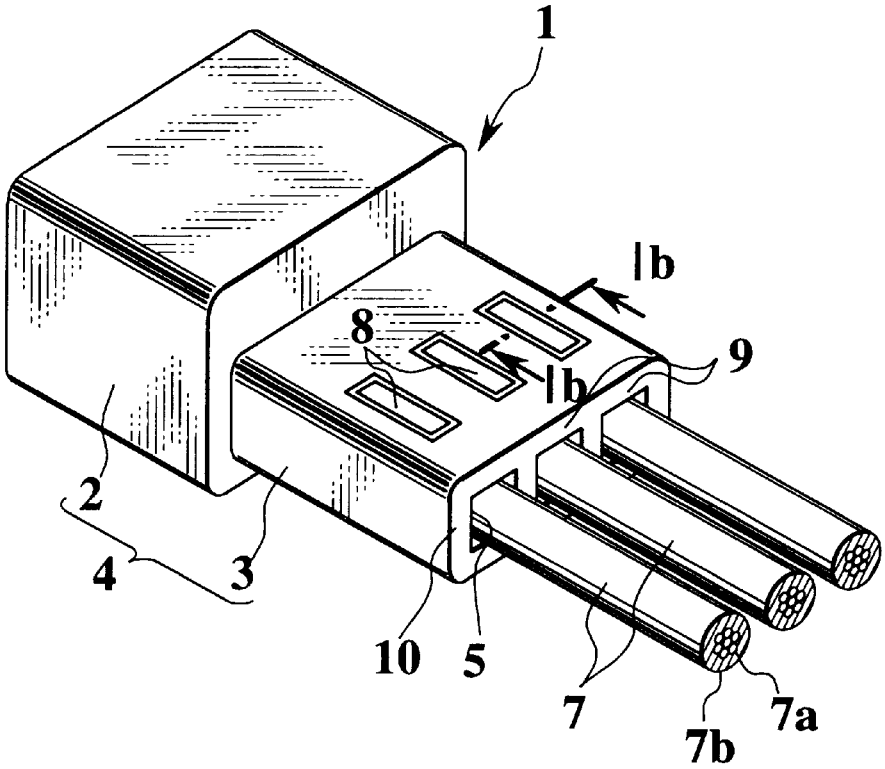

FIG. 3A is a connector 1 having a wire connecting structure according to a first embodiment of the present invention. This connector 1 comprises a housing 4 including a connector housing body 2 containing a male terminal to which a female terminal (not shown) of a mating connector is to be connected and a terminal holding portion 3 formed so to protrude from an end of the connector housing body 2, as shown in FIG. 3A. In the terminal holding portion 3 are formed terminal incorporating holes 5 communicating with the connector housing body 2 so as to run therethrough. Each of the terminal incorporating holes 5 has such a wire connecting structure in which a terminal 6 to be connected to the aforementioned terminal is introduced therein and each of covered wires 7 is connected to the terminal 6.

Figure 3B:
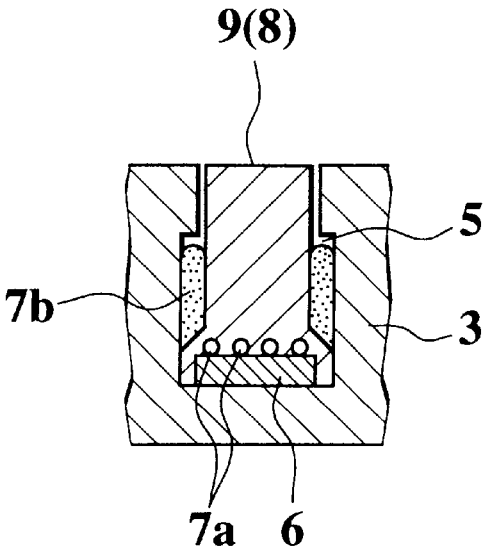

As for this wire connecting structure, as shown in FIG. 3B, the covered wires 7 placed on the terminal 6 are pressed through a upper hole wall portion 9 in each of the terminal incorporating holes 5 and subjected to ultrasonic vibration. Consequently, core elements 7*a* of a covered wire 7 are conductively contacted with each other and the upper hole wall portion 9 is settled by fusion into each of the terminal incorporating holes 5.

Figure 1A:
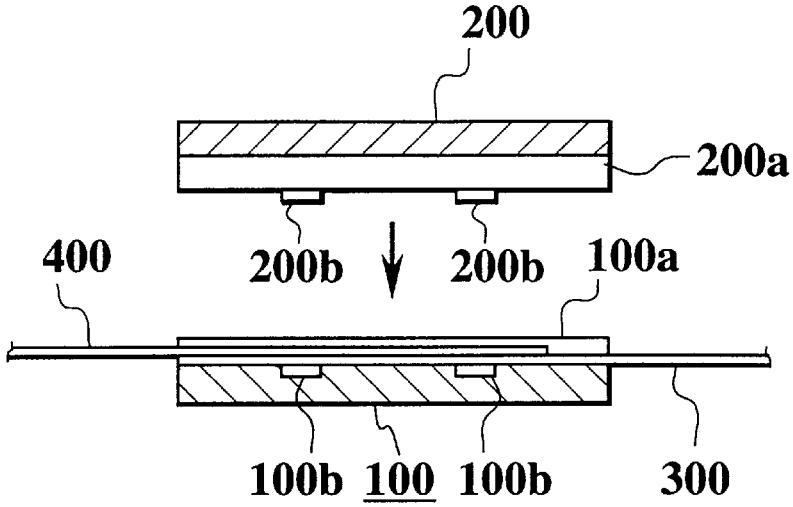
FIG.1A PRIOR ART
Figure 1B:
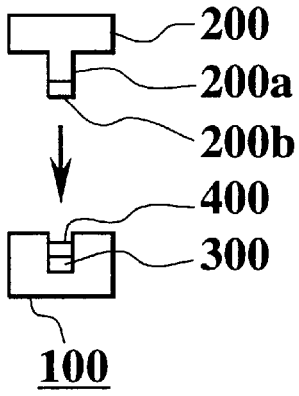
FIG.1B PRIOR ART
Figure 2:
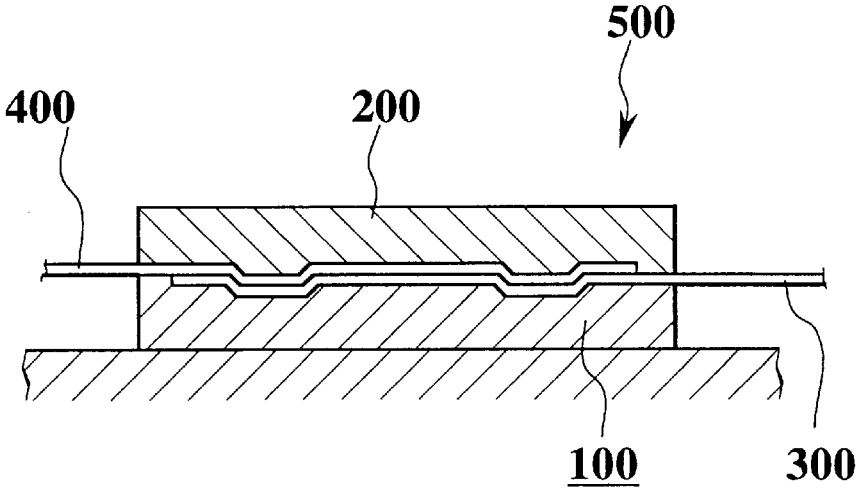
FIG.2 PRIOR ART
FIG. 2 is a longitudinal sectional view of a production step of the connector shown in FIG. 1.

According to the present embodiment, as shown in FIG. 2, the upper hole wall portion 9 has protrusions 8 which are cubes having longer horizontal sides, protruding above outside face and form external wall 10 of the terminal holding portion 3. The portion in which the protrusion 8 is formed is so constructed as to subside into each of the terminal incorporating holes 5.

This wire connecting structure can be produced in the following manner.

First, as shown in FIG. 2, each of the covered wires 7 is inserted into each of the terminal incorporating holes 5 in the terminal holding portion 3 and placed on the terminal 6. Only by inserting each of the covered wires 7 into each of the terminal incorporating holes 5, a position of the covered wire 7 relative to the terminal 6 is automatically determined.

Figure 4:
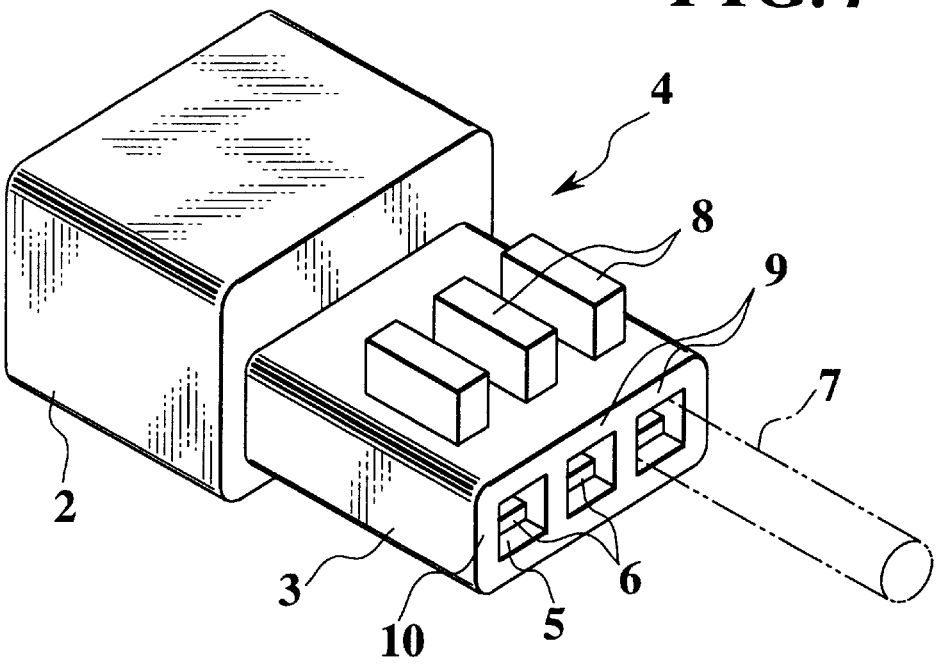
FIG. 4 is a perspective view of the connector housing of the connector shown in FIG. 3A.
Figure 5:
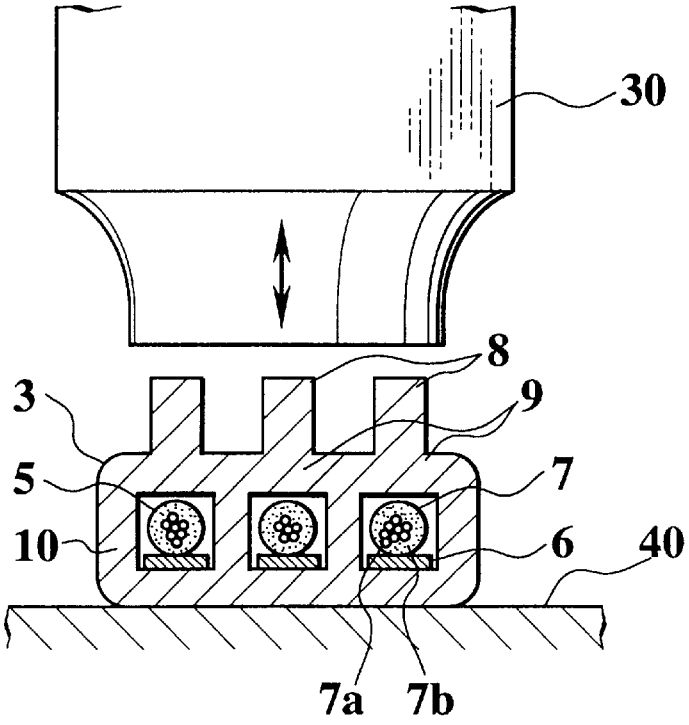
FIG. 5 is an explanatory view showing a production step of the connector shown in FIG. 3A.

Next, as shown in FIG. 3, the terminal holding portion 3 is placed on a base 40 and a ultrasonic horn 30 is descended so as to contact a top face of each of the protrusion 8. Ultrasonic vibration is applied with the protrusions 8 being pressed by the ultrasonic horn 30. By this ultrasonic vibration, as shown in FIG. 4, a portion 9*a* corresponding to a root circumference of the protrusion 8 of the upper hole wall portion 9 is shorn so that the upper hole wall portion 9 subsides into each of the terminal incorporating holes 5 together with the protrusion 8. After that, by pressing the covered wires 7 by means of the ultrasonic horn 30 through the sunk upper hole wall portion 9, the ultrasonic vibration is continued. As shown in FIG. 3B, a cover portion 7*b* of the covered wires 7 is melted and removed, and the core elements 7*a* of the covered wires 7 are conductively contacted with the terminal 6. Further, an end of the upper hole wall portion 9 is melted so that it is settled by fusion with the terminal incorporating holes 5, thereby securing the aforementioned conductive contacting condition. Consequently, the wire connecting structure according to the first embodiment can be obtained. The 7*b* of the 7 melted and removed at this time, as shown in FIG. 3*b*, remains in a gap between the upper hole wall portion 9 (and 8) which subsided and each of the 5 in the form of synthetic resin lump.

According to the wire connecting structure of the first embodiment, by inserting each of the covered wires 7 into each of the terminal incorporating holes 5, positioning of the covered wire 7 relative to the terminal 6 is achieved. Further because the upper hole wall portion 9 which subsided into each of the 5 together with the protrusion 8 is interposed upon ultrasonic vibration by the ultrasonic horn 30, positioning of the interposed part is not required and other interposed parts such as a cover or the like are not required. Thus, the number of components can be reduced.

Further, according to this production method of the wire connecting structure, subsiding of the upper hole wall portion 9, conductive contacting of the core elements 7*a* of the covered wires 7 with the terminal 6 and fusion of the sunk upper hole wall portion 9 within each of the terminal incorporating holes 5 can be achieved in a single step by the ultrasonic horn 30. Thus, effectiveness of the work can be achieved thereby contributing to improvement of production efficiency as well as unnecessity of positioning of the interposed parts and reduction of the number of the components.

Figure 7:
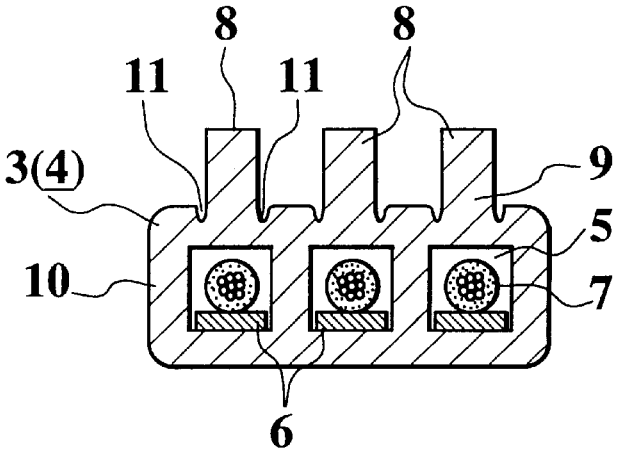
FIG. 7 is a sectional view of major portion of a connector housing for use in a wire connecting structure according to a second embodiment of the present invention.

FIG. 7 shows a terminal holding portion 3 of a housing 4 for use in the wire connecting structure of a connector according to a second embodiment of the present invention.

In this terminal holding portion 3 are formed terminal incorporating holes 5 like the aforementioned first embodiment so that they run therethrough. The 9 of the 5 has protrusions 8 protruding above the external face like the first embodiment so as to form an external wall 10 of a terminal holding portion 3. Further, there are formed cutting trigger means 11 composed of cut-in or groove on the external face along a root of each of the protrusion 8.

According to the second embodiment, when the protrusion 8 of the ultrasonic horn 30 is pressed and subjected to ultrasonic vibration according to the aforementioned production method of the first embodiment, the upper hole wall portion 9 is shorn at the cutting trigger means 11 so that the upper hole wall portion 9 subsides into each of the terminal incorporating holes 5.

As described above, according to the wire connecting structure of the second embodiment, subsiding of the upper hole wall portion 9 is facilitated by the cutting trigger means 11. Further, only the upper hole wall portion 9 can be sunk without damaging other portions of the external wall 10 of the terminal holding portion 3, thereby improving work efficiency.

Figure 6:
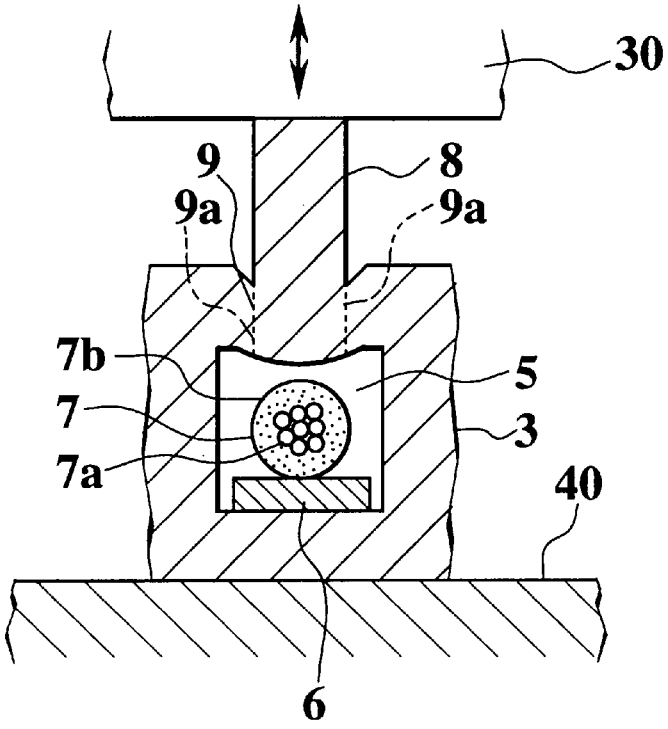
FIG. 6 is an explanatory view showing a production step of the connector shown in FIG. 3A.

FIG. 6 is a modification of the first embodiment, which is different therefrom only in the terminal incorporating holes 5 formed in the terminal holding portion 3. The other structure is the same as the first embodiment.

Figure 8A:
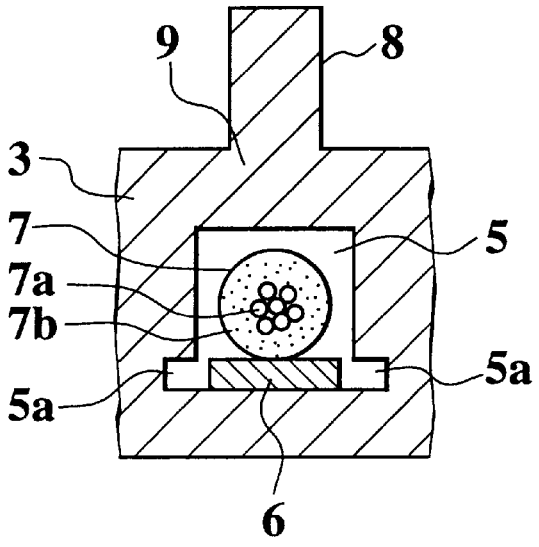
Figure 8B:
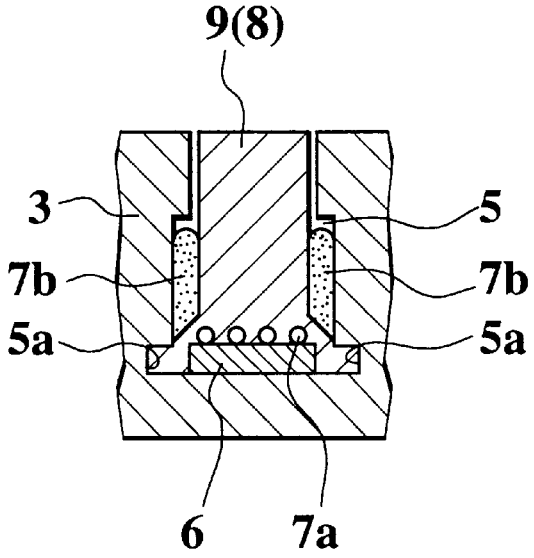

The terminal incorporating hole 5 of this modification has concave portions 5*a* which are open to the terminal incorporating hole 5, the concave portions 5*a* being formed on both sides along the bottom of the terminal incorporating hole 5, as shown in FIG. 8B.

Thus, in this modification, when the core elements 7*a* of each of the covered wires 7 are conductively contacted with the terminal 6 through the sunk upper hole wall portion 9 by ultrasonic vibration, the end of the upper hole wall portion 9 is melted as shown in FIG. 8B so that the melted portion invades into the concave portions 5*a* and is settled by fusion within each of the terminal incorporating holes 5. As a result, the conductive contacting between the core elements 7*a* and the terminal 6 can be maintained stably.

FIG. 7 shows a terminal holding portion 3 of a housing 4 used in the wire connecting structure of a connector according to a third embodiment of the present invention.

In the terminal holding portion 3 are formed the terminal incorporating holes 5 like the aforementioned first embodiment as shown in FIG. 9A. The upper hole wall portion 9 of each of the terminal incorporating holes 5 has the cutting trigger means 11 on its external face like the second embodiment so as to form the external wall 10 of the terminal holding portion 3. The external face of the upper hole wall portion 9 has no protrusion 8 unlike the first embodiment, so that it is formed in a flat shape. Further, the cutting trigger means 11 is formed so as to be incised into the external face in rectangular shape surrounding a portion to be sunk.

On the other hand, the ultrasonic horn 30 for use in the present embodiment contains a plurality of the pressing elements 31 which correspond to intervals of the terminal incorporating holes 5, as shown in FIG. 9A.

According to the present embodiment, a front end of each of the pressing elements 31 is made into contact with the portion to be sunk of the upper hole wall portion 9 and the portions to be sunk are subjected to ultrasonic vibration while pressed by the ultrasonic horn 30. By this ultrasonic vibration, the upper hole wall portion 9 is shorn along the cutting trigger means 11 so as to subside into each of the terminal incorporating holes 5. Each of the pressing elements 31 invades into each of the terminal incorporating holes 5 by means of the ultrasonic horn 30 which descends further. Each of the pressing elements 31 invading into each of the terminal incorporating holes 5 presses the covered wires 7 through the sunk upper hole wall portion 9 and vibrates ultrasonically. By this ultrasonic vibration, as shown in FIG. 9B, conductive contacting between the core elements 7*a* of the covered wires 7 and the terminal 6 is obtained. At the same time, the front end of the sunk upper hole wall portion 9 is melted and settled by fusion in each of the terminal incorporating holes 5. At this time, the melted cover portion 7*b* is not fused with the pressing elements 31.

The wire connecting structure of the third embodiment is capable of exerting the same effect as the second embodiment by means of the cutting trigger means 11.

FIG. 10A shows a terminal holding portion 3 of a housing 4 for use in the wire connecting structure of a connector according to a fourth embodiment of the present invention.

As shown in FIG. 10A, the terminal holding portion 3 contains the terminal incorporating holes 5 like the first embodiment. The upper hole wall portion of this terminal incorporating hole 5 is formed of a block body 12 provided so as to close that upper open portion of the terminal incorporating hole 5 through thin portions 13 on both sides. This block body 12 is formed of a cube comprising a upper portion 12*a* which protrudes outwardly and a lower portion 12*b* which protrudes into each of the terminal incorporating holes 5, and formed integrally with the terminal holding portion 3 such that the middle portion on both side thereof is connected through the thin portions 13.

The terminal holding portion 3 according to the fourth embodiment, preferably as shown in FIG. 10A, contains small protrusions 14 which protrude above the external face corresponding to upper open edges of each of the terminal incorporating holes 5. This small protrusion 14 is formed so as to protrude surrounding, for example, the block body 12. This small protrusion 14 may be formed in plurality with appropriate intervals.

In this embodiment, according to the same method as the first embodiment, as shown in FIG. 10A, the block body 12 subsides into each of the terminal incorporating holes 5 when the thin portions 13 are shorn. Then, while the sunk block body 12 presses the covered wires 7 in the terminal incorporating hole 5, ultrasonic vibration is applied so as to make the core elements 7*a* of the covered wires 7 and the terminal 6 into conductive contact with each other. At the same time, the sunk block body 12 can be settled by fusion in each of the terminal incorporating holes 5. At a final stage of this production step, the ultrasonic horn 30 applies ultrasonic vibration while pressing the small protrusions 14. As a result, the small protrusions 14 are melted so that a gap between the block body 12 and an upper opening of the terminal incorporating hole 5 is clogged (see FIG. 10A).

The wire connecting structure of the fourth embodiment effectively prevents a slippage of the block body 12 from each of the terminal incorporating holes 5 by melting of the small protrusions 14 and maintains conductive contact between the core elements 7*a* of the covered wires 7 and terminal 6 stably.

Although according to the production method described above, the ultrasonic horn 30 is utilized as a means for sinking the upper hole wall portion 9 (or block body 12), it is permissible to use a cutter means instead of this ultrasonic horn 30.

This cutter means is so structured to have an appropriate cutter blade capable of cutting the upper hole wall portion 9 (cutting trigger means 12, thin portion 13).

In this case, the production method is as follows.

That is, after the upper hole wall portion 9 (block body 12) is sunk into each of the terminal incorporating holes 5 by cutting with the cutter means, the covered wires 7 are pressed through the sunk upper hole wall portion 9 (block body 12) and subjected to ultrasonic vibration. By this ultrasonic vibration, the core elements 7*a* of the covered wires 7 are conductively contacted with the terminal 6.

According to the production method based on the cutter means, only the upper hole wall portion 9 (block body 12) can be sunk easily by the cutter means. As a result, good-looking wire connecting structure of the connector can be provided without damaging the other portions of the external wall 10 of the terminal holding portion 3.

While preferred embodiments of the present invention have been described using specific terms, such description is for illustrative purposes, and it is to be understood that changes and variations may be made without departing from the spirit or scope of the following claims.

What is claimed is:

1. A wire connecting structure, comprising:

a connector housing;

a terminal holding portion protruding from an end of said connector housing and having terminal holes communicating with said connector housing, and an upper hole wall portion defining a plurality of pressing block formations, each of the plurality of pressing block formations corresponding to one of the terminal holes;

conductive terminals disposed within said terminal holes; and covered wires placed on said terminals, said covered wires having conductive core elements, wherein each of said pressing block formations is configured to be separately pressed into the corresponding one of said terminal holes to contact said covered wires, and said conductive core elements and said terminals conductively contact with each other when said pressing block formations are pressed into said terminal holes and ultrasonic vibration is applied to said pressing block formations.

2. The wire connecting structure according to claim 1, wherein said pressing block formations extend above an external face of said terminal holding portion.

3. The wire connecting structure according to claim 1 or 2 further comprising: cutting trigger means provided in said terminal holding portion over each of said terminal holes; and each of said pressing block formations configured to sink into each of said terminal holes when said cutting trigger means is broken, and fused in each of said terminal holes.

4. The wire connecting structure according to claim 1, wherein each of said terminal holes has an upper opening, and each of said pressing block formations has a thin portion, for closing said upper opening.

5. The wire connecting structure according to claim 1, wherein each of said pressing block formations has a pressing width for each of said terminal holes.

6. A wire connecting structure of a connector, comprising:

a connector housing;

a terminal holding portion protruding from an end of said connector housing and having terminal holes communicating with said connector housing;

conductive terminals disposed within said terminal holes;

covered wires placed on said terminals, said covered wires having conductive core elements; and upper wall portions provided in said terminal holding portion to define upper portions of said terminal holes, said upper hole wall portions being configured to be pressed into said terminal holes to contact said covered wires, said upper wall portion being a block body connected to said terminal holding portion through thin portions for clogging said upper opening, wherein said core elements and said terminal are subjected to said ultrasonic vibration through said upper wall portion to conductively contact with each other, said terminal holding portion has small protrusions extending above an external face thereof at an edge of said upper opening, and said small protrusion clogs a gap between said block body melted by said ultrasonic vibration and sunk, and said edge.

* * * * *